US008114228B2

(12) United States Patent
Hori et al.

(10) Patent No.: US 8,114,228 B2
(45) Date of Patent: Feb. 14, 2012

(54) GAS GENERATING COMPOSITION

(75) Inventors: Keiichi Hori, Kanagawa (JP); Toshiyuki Katsumi, Kanagawa (JP); Shogo Tomiyama, Hyogo (JP); Syouji Kobayashi, Hyogo (JP); Ko Murakami, Osaka (JP)

(73) Assignees: Daicel Chemical Industries, Ltd., Osaka-Shi (JP); Japan Aerospace Exploration Agency, Chofu-Shi (JP)

( * ) Notice: Subject to any disclaimer, the term of this patent is extended or adjusted under 35 U.S.C. 154(b) by 314 days.

(21) Appl. No.: 12/000,317

(22) Filed: Dec. 11, 2007

(65) Prior Publication Data

US 2008/0178975 A1 Jul. 31, 2008

(30) Foreign Application Priority Data

Dec. 12, 2006 (JP) ..... 2006-334022

(51) Int. Cl.

| | |
|---|---|
| ***C06B 47/00*** | (2006.01) |
| ***C06B 31/00*** | (2006.01) |
| ***D03D 23/00*** | (2006.01) |
| ***D03D 43/00*** | (2006.01) |

(52) U.S. Cl. ..... 149/1; 149/45; 149/108.8; 149/109.2; 149/109.4

(58) Field of Classification Search ..... 149/2, 1, 149/45, 108.8, 109.2, 109.4
See application file for complete search history.

(56) References Cited

U.S. PATENT DOCUMENTS

| | | | | |
|---|---|---|---|---|
| 3,331,717 | A * | 7/1967 | Cook et al. | 149/38 |
| 3,634,154 | A * | 1/1972 | Burdette | 149/20 |
| 3,790,415 | A * | 2/1974 | Tomic | 149/2 |
| 6,228,193 | B1 * | 5/2001 | Blomquist | 149/19.91 |
| 2004/0054069 | A1 * | 3/2004 | Kusudou et al. | 524/557 |

FOREIGN PATENT DOCUMENTS

| | | | |
|---|---|---|---|
| JP | 11-1386 | A | 1/1999 |
| WO | WO-99/64375 | * | 12/1999 |

* cited by examiner

*Primary Examiner* — James McDonough
(74) *Attorney, Agent, or Firm* — Birch, Stewart, Kolasch & Birch, LLP

(57) ABSTRACT

The present invention provides a liquid gas generating composition comprising the following (a) to (c) components, wherein the content ratio of (b) component is 0.5 mass % or more and less than 5.0 mass %:

(a) hydroxyammonium nitrate;
(b) a thickening stabilizer; and
(c) water.

15 Claims, No Drawings

GAS GENERATING COMPOSITION

This nonprovisional application claims priority under 35 U.S.C. §119(a) on Patent Application No. 2006-334022 filed in Japan on 12 Dec. 2006, which is incorporated by reference.

BACKGROUND OF INVENTION

1. Field of the Invention

The present invention relates to a liquid gas generating composition and to a gel-like gas generating composition that can be employed in an airbag apparatus or the like for an automobile.

2. Description of Related Arts

The conventional gas generating compositions sometimes contain a substance causing to generate a hazardous substance such as halogens in released gases. However, because hydroxyammonium nitrate (HAN) does not contain source substances generating toxic substances, the released gases can be cleaned by using HAN as an oxidizing agent.

Further, in the conventional gas generating compositions, a proportionate amount of combustion residues derived from the oxidizing agent is ejected together with the high-temperature gas. Therefore, a large amount of filtering material has to be incorporated in the airbag inflator structure. However, where HAN is used as the oxidizing agent, the residues are not formed or practically not formed, thereby making the filtering material unnecessary or requiring only a small amount thereof to be incorporated in the structure.

JP-A No. 11-1386 discloses a solid propellant obtained by mixing HAN and a binder serving as a fuel component, such as a polysulfide, polyvinyl chloride, polyurethane, a polyesters, a carboxyl-terminated polybutadiene, a hydroxyl-terminated polybutadiene, and a glycidylazide polymer.

U.S. Pat. No. 6,228,193 discloses a gas generating agent including HAN and a gelling agent. Polyvinyl alcohol is presented as an example of the gelling agent, and the content ratio of the gelling agent is described to be 5 to 25 mass %.

SUMMARY OF THE INVENTION

The present invention provides a liquid gas generating composition including the following (a) to (c) components, wherein the content ratio of (b) component is 0.5 mass % or more and less than 5.0 mass %:

(a) hydroxyammonium nitrate;

(b) a thickening stabilizer; and (c) water.

The present invention provides a gel-like molded article of a gas generating composition obtained by molding the above shown liquid gas generating composition.

DETAILED DESCRIPTION OF THE INVENTION

Because the conventional gas generating agents for airbag inflators are solids, similarly to the solid propellant of JP-A No. 11-1386, such processes as mixing, molding, and drying are necessary, and the number of processes involved is large.

HAN is a liquid containing a small amount of water and the direct combustion thereof causes scattering by bursting gas, making the combustion unstable, but improving the strength to a certain degree ensured by gelling can provide for stable combustion. In the composition of U.S. Pat. No. 6,228,193, the concentration of gelling agent is as high as 5 to 25% (the lowest concentration in the examples is 12%). As a result, the amount of HAN that functions as a fuel and an oxidizing agent in the gas generating composition decreases.

The present invention provides a liquid gas generating composition, that can be easily manufactured by a process involving a small number of operations and generates clean gas and an extremely small amount of combustion residues, and also a gel-like molded article of a gas generating composition that is obtained from the gas generating composition.

According to the present invention, the term "gel-like" includes a gel and a state in which a constant shape (three- or two-dimensional) is formed and maintained by thickening, although this state is not a gel.

Because the gel-like molded article of a gas generating composition in accordance with the present invention uses a liquid gas generating composition, the number of operations is reduced and the manufacturing process is facilitated in comparison to manufacturing a molded article of a solid gas-generating agent. Furthermore, with the gel-like molded article of a gas generating composition in accordance with the present invention, the amount of generated combustion residues is extremely small and the generated gas is clean.

EMBODIMENTS OF THE INVENTION

<Gas Generating Composition>

(a) Component

HAN (hydroxyammonium nitrate) that is (a) component is a known compound. HAN can be employed, for example, in the form of an aqueous solution with a concentration of about 92 to 95 mass % that is obtained by dropwise adding nitric acid to a 50% aqueous solution of hydroxylamine, conducting a reaction and, if necessary, concentrating under reduced pressure, and also in the form of crystals obtained from the aqueous solution.

The content ratio of (a) component in the composition in accordance with the present invention is preferably 60 to 87 mass %, more preferably 70 to 86 mass %, and even more preferably 80 to 85 mass %.

(b) Component

The thickening stabilizer that is (b) component is a polymer that is viscous when dissolved or dispersed in water and it can act as a thickening agent or a gelling agent.

Carboxymethyl cellulose sodium salt (CMCNa) is preferred as the thickening stabilizer that is (b) component. Other preferred agents include a combination of CMCNa and potassium alum ($KAl(SO_4)_2 \cdot 12H_2O$), a combination of CMCNa and titanium lactate, or a combination of CMCNa and basic aluminum acetate.

If necessary, as auxiliary components of (b) component, other known thickening agents, gelling agents, binders, and the like may be compounded in a small amount (preferably, 50 parts by mass or less per 100 parts by mass of (b) component) within such a range that the invention can be worked.

Examples of well-known thickening agents, gelling agents, and binders include carrageenan, pectin, arginine carbomer, sodium alginate, propylene glycol alginate, xanthan gum, guar gum, gum arabic, cyclodextrin, sodium polyacrylate, carboxymethyl cellulose, carboxymethyl cellulose potassium salt, carboxymethyl cellulose ammonium salt, cellulose acetate, cellulose acetate butyrate, methyl cellulose, ethyl cellulose, hydroxyethyl cellulose, ethyl hydroxyethyl cellulose, hydroxypropyl cellulose, carboxymethyl ethyl cellulose, microcrystalline cellulose, polyacrylamides, amino compounds of polyacrylamides, polyacrylhydrazide, copolymers of acrylamide and metal salt of acrylic acid, copolymers of polyacrylamides and acylic rubber, starch, silicones, and the like.

The content ratio of (b) component in the composition in accordance with the present invention is 0.5 mass % to less than 5.0 mass %, preferably 1.0 to 4.9 mass %, more preferably 2.0 to 4.5 mass %, even more preferably 2.0 to 4.3 mass %. By making the content ratio of (b) component less than 5.0 mass %, it is possible to increase the content of HAN that is (a) component. Therefore, a larger amount of generated gas and a higher burning rate can be obtained.

When (b) component is a combination of CMCNa and potassium alum, the total content ratio of the CMCNa and potassium alum in the composition in accordance with the present invention is within the above-described ranges.

The weight ratio (CMCNa/potassium alum) of CMCNa and potassium alum in the combination thereof is preferably 0.25 to 40, more preferably 0.5 to 20, still more preferably 1 to 10.

When (b) component is a combination of CMCNa and titanium lactate, the total content ratio of the CMCNa and titanium lactate in the composition in accordance with the present invention is within the above-described ranges.

The weight ratio (CMCNa/titanium lactate) of CMCNa and titanium lactate in the combination thereof is preferably 0.25 to 40, more preferably 0.5 to 20, still more preferably 1 to 10.

When (b) component is a combination of CMCNa and basic aluminum acetate, the total content ratio of the CMCNa and basic aluminum acetate in the composition in accordance with the present invention is within the above-described ranges.

The weight ratio (CMCNa/basic aluminum acetate) of CMCNa and basic aluminum acetate in the combination thereof is preferably 0.25 to 40, more preferably 0.5 to 20, still more preferably 1 to 10.

(c) Component

Water that is (c) component is added, as necessary, in the manufacturing process in addition to water contained in (a) component and (b) component.

The content ratio of (c) component in the composition in accordance with the present invention is preferably 8.7 to 12.7 mass %, more preferably 10.2 to 12.5 mass %, and even more preferably 11.6 to 12.4 mass %.

Other Components

Known additives for gas generating compositions can be compounded with the composition in accordance with the present invention as long as the invention can be worked.

Examples of additives include metal oxides such as iron oxide, zinc oxide, cobalt oxide, manganese oxide, molybdenum oxide, nickel oxide, bismuth oxide, silica, and alumina, metal hydroxides such as cobalt hydroxide and iron hydroxide, metal carbonates or basic metal carbonates such as cobalt carbonate, calcium carbonate, basic zinc carbonate, and basic copper carbonate, complex compounds of metal oxides or metal hydroxides such as Japanese acid clay, kaolin, talc, bentonite, diatomaceous earth, and hydrotalcite, metallic acid salts such as sodium silicate, mica molybdate, cobalt molybdate, and ammonium molybdate, and also silicones, molybdenum dioxide, calcium stearate, silicon nitride, and silicon carbide.

The composition in accordance with the present invention is a liquid obtained by mixing the above-described (a) to (c) components and other components that are compounded as necessary. The composition may have any viscosity that allows the composition to be poured into a mold after optional heating and be molded; thus, the viscosity can be within a range of from about 0.2 kPa to 2000 kPa.

Molded Article of Gas Generating Composition

The molded article of the gas generating composition in accordance with the present invention is a gel molded article by pouring the above-described liquid gas generating composition into a mold of a desired shape and solidifying.

The molded article of the gas generating composition in accordance with the present invention can be loaded into an airbag inflator, and taking into account the utilization mode of an automobile, the composition may have a strength sufficient to maintain the predetermined shape within a temperature range of from −40° C. to 110° C.

The molded article of the gas generating composition in accordance with the present invention preferably has a gel strength of from 20 to 1000 kPa, more preferably from 50 to 600 kPa, even more preferably from 100 to 300 kPa.

The molded article of the gas generating composition in accordance with the present invention preferably has a burning rate of 5 mm/sec or more, more preferably 7 to 100 mm/sec, and even more preferably 10 to 50 mm/sec. The burning rate is found by the method described in Examples.

The molded article of the gas generating composition in accordance with the present invention can have the desired shape such as a cylindrical shape or disk-like (pellet-like) shape and may be provided with a recess or a hole.

The molded article of the gas generating composition in accordance with the present invention can be applied to an airbag inflator for a driver side, an airbag inflator for a passenger side next to the driver, a side airbag inflator, an inflator for an inflatable curtain, an inflator for a knee bolster, an inflator for an inflatable seat belt, an inflator for a tubular system, and an inflator for a pretensioner of a variety of vehicles.

The molded article of the gas generating composition in accordance with the present invention can be employed not only as a gas generating composition for inflators, but also as an igniting agent called an enhancer agent (or a booster) for transferring the energy of a detonator or a squib to the gas generating composition.

EXAMPLES (1) Measurement of Gel Strength

Device Used

Rheometer, MODEL: CR-500DX (manufactured by SUN SCIENTIFIC CO., LTD.).

Data processing: RHEO DATA ANALYZER for Win (Windows 98/95).

Measurement Conditions

Constant-depth measurement method (gelatin strength measurement and the like): a stress is measured that is applied to an adapter of a rheometer when the adapter is introduced to a set distance into a sample that is stationary disposed inside a polypropylene container with a diameter of 60 mm and a height of 45 mm.

Adapter; diameter 25 mm.
Insertion rate: 60 mm/min.
Set distance (insertion depth): 10 mm.
Adapter: diameter 15 mm.
Insertion rate: 60 mm/min.
Depth: 10 mm.
Full scale: 10 kg.

Measurement Sequence (1) The prepared gel is introduced from below to a height of 20 mm into a PP container having an inner diameter of 60 mm and a height of 45 mm.

(2) In 24 hours after gelling, measurements are conducted with the rheometer.

(3) Measurement conditions are described above (insertion depth is half the height of the gel).

(4) The highest stress value is read, and the value (g/cm$^2$) obtained by dividing the highest stress value by the surface area (4.906 cm$^2$) of the adapter is taken as the gel strength.

(2) Method for Preparing a Strand

Each liquid composition of the Examples and Comparative Examples was introduced into a 100 mL beaker and stirred at an ambient temperature. The mixed liquid was rapidly poured into a mortar-shaped die having an inner diameter of 9.6 mm and a height of 70.0 mm and allowed to stay for 24 hours at an ambient temperature to solidify the liquid composition. The solidified mass was extruded with a pestle and a strand having a diameter of 9.5 mm and a length of 50 mm was obtained. The strand was divided into four strands of equal length that were used as test strands.

(3) Method for Measuring the Burning Rate

The test strand was disposed in a sealed cylinder made from SUS and having an inner capacity of 1 L, and the pressure inside the cylinder was raised to, and stabilized at, 7 MPa, while replacing the entire atmosphere inside the cylinder with nitrogen. Then, a predetermined electric current was passed to a nichrome wire that was brought into contact with the end surface of the strand, and the ignition and combustion were induced by the fusing energy thereof. The variation of pressure inside the cylinder with time was confirmed by a recorder chart, the time elapsed from the start of combustion to the pressure rise peak was determined from the chart scale, and the numerical value obtained by dividing the strand length prior to combustion by the elapsed time was taken as a burning rate.

(4) Method for Measuring Gas Concentration

The test strand was disposed in a sealed cylinder made from SUS and having an inner capacity of 1 L, and the pressure inside the cylinder was raised to, and stabilized at, 7 MPa, while replacing the entire atmosphere inside the cylinder with nitrogen. Then, a predetermined electric current was passed to a nichrome wire that was brought into contact with the end surface of the strand, and the ignition and combustion were induced by the fusing energy thereof. After waiting for 60 seconds till the gas inside the cylinder became homogeneous, an open plug portion of a Tedlar bag equipped with a predetermined plug was connected to the gas release portion of the cylinder, the combustion gas contained in the cylinder was sampled by transferring, and the concentrations of $NO_2$, NO, $NH_3$, and CO were measured with Gastec gas detection tubes (for $NO_2$ and NO detection: No. 10; for $NH_3$ detection: No. 3L; for CO detection: No. 1L) by using a GV-100S detector manufactured by GASTEC CORPORATION.

(5) Mass of Recovered Residue

Upon completion of the "(4) Method for measuring gas concentration" test, the internal state of the cylinder was observed, and residues inside the cylinder were recovered, and the mass was measured after drying for 16 hours at 110° C.

Preparation Example 1

Preparation of Aqueous Solution of HAN

A total of 750 mL of a 50% aqueous solution of hydroxyamine was placed into a three-neck flask having a capacity of 2000 mL that was equipped with a thermometer, a stirrer, and a pH meter, a product of NISSHIN KAKO KABUSHIKI KAISHA, and the solution was cooled to −5° C. to 0° C.

Then, about 940 mL of nitric acid (1.38 N) was dropwise added into the flask under cooling and stirring. The dropping rate of nitric acid was adjusted so as to maintain the solution temperature during dropping at 5±2° C. Dropping of nitric acid was completed once the pH of the solution reached 4.

Upon completion of dropping, the solution temperature inside the flask was gradually returned to room temperature. The concentration of HAN (calculated as hydroxylamine) in the aqueous solution at this time was about 50 to 55%.

Then, the pressure was reduced to 16±2 mm Hg by using an evaporator under heating at 55±3° C. and the solution was concentrated. The concentration process was continued till the amount of distillate reached about 850 mL. The aqueous solution of HAN at this time was a transparent liquid, and the concentration of HAN (calculated as hydroxylamine) was about 87.3 mass %.

Example 1

A composition in accordance with the present invention was obtained by mixing 83.0 mass % HAN of Preparation Example 1, 3.9 mass % CMCNa, 1.0 mass % potassium alum, and 12.1 mass % water. The measurement results of each evaluation are shown in Table 1.

Example 2

A composition in accordance with the present invention was obtained by replacing the potassium alum of Example 1 with 1.0 mass % basic aluminum acetate. The measurement results of each evaluation are shown in Table 1.

Example 3

A composition in accordance with the present invention was obtained by replacing the potassium alum of Example 1 with 1.0 mass % titanium acetate. The measurement results of each evaluation are shown in Table 1.

Example 4

A composition in accordance with the present invention was obtained by mixing 84.3 mass % HAN of Preparation Example 1, 3.0 mass % CMCNa, 0.50 mass % potassium alum, and 12.3 mass % water. The measurement results of each evaluation are shown in Table 1.

Example 5

A composition in accordance with the present invention was obtained by mixing 83.8 mass % HAN of Preparation Example 1, 4.0 mass % CMCNa, and 12.2 mass % water. The measurement results of each evaluation are shown in Table 1.

Comparative Example 1

The aqueous solution of HAN (HAN concentration 87.3 mass %) of Preparation Example 1 was poured into a SUS cup having an inner diameter of 9.6 mm, a height of 20.0 mm, and a thickness of 0.5 mm so that the level of liquid reached a height of 12.7 mm. Four such samples were prepared and evaluation of each kind was performed in the same manner as in Example 1.

Comparative Example 2

A strand was obtained by mixing 65.5 mass % HAN of Preparation Example 1, 25 mass % CMCNa, and 9.5 mass % water.

The measurement results of each evaluation are shown in Table 1.

Comparative Example 3

A strand was obtained by mixing 1.0 mass % potassium alum and 9.4 mass % water with 64.8 mass % HAN of Preparation Example 1 and 24.8 mass % CMCNa. The measurement results of each evaluation are shown in Table 1.

TABLE 1

| | Composition | Gel Strength | Burning Rate | Composition of Released Gas ppm | | | | Amount of Recovered Residues |
|---|---|---|---|---|---|---|---|---|
| | mass % | kPa | mm/sec | $NO_2$ | NO | $NH_3$ | CO | mg |
| Example 1 | HAN/CMCNa/potassium alum/$H_2O$ = 83.0/3.9/1.0/12.1 | 20 | 35 | 50 | 90 | 0 | 150 | 11 |
| Example 2 | HAN/CMCNa/basic aluminum acetate/$H_2O$ = 83.0/3.9/1.0/12.1 | 25 | 31 | 30 | 80 | 0 | 100 | 6 |
| Example 3 | HAN/CMCNa/titanium lactate/$H_2O$ = 83.0/3.9/1.0/12.1 | 30 | 30 | 20 | 80 | 0 | 100 | 5 |
| Example 4 | HAN/CMCNa/potassium alum/$H_2O$ = 84.3/3.0/0.50/12.3 | 15 | 35 | 30 | 90 | 0 | 100 | 8 |
| Example 5 | HAN/CMCNa/$H_2O$ = 83.8/4.0/12.2 | 10 | 37 | 50 | 100 | 0 | 150 | 0 |
| Comparative Example 1 | HAN/$H_2O$ = 87.3/12.7 | 0 | Abnormal combustion, measurements impossible | 150 | 400 | 0 | 0 | 0 |
| Comparative Example 2 | HAN/CMCNa/$H_2O$ = 65.5/25/9.5 | 200< | 21 | 100 | 250 | 5 | 800 | 0 |
| Comparative Example 3 | HAN/CMCNa/potassium alum/$H_2O$ = 64.8/24.8/1.0/9.4 | 200< | 20 | 100 | 250 | 5 | 700 | 15 |

The invention thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A liquid gas generating composition comprising the following (a) to (c) components, wherein the content ratio of (a) component is 80 mass % to 85 mass % and (b) component is 0.5 mass % to 5.0 mass %:

(a) hydroxyammonium nitrate;

(b) a thickening stabilizer comprising carboxymethyl cellulose sodium salt (CMCNa); and (c) water.

2. The liquid gas generating composition according to claim 1, wherein the thickening stabilizer, which is (b) component, comprises a combination of CMCNa and potassium alum, a combination of CMCNa and titanium lactate, or a combination of CMCNa and basic aluminum acetate.

3. The liquid gas generating composition of claim 1, wherein the content ratio of component (b) is 1.0 mass % to 4.9 mass %.

4. The liquid gas generating composition of claim 1, wherein the content ratio of component (b) is 2.0 mass % to 4.5 mass %.

5. The liquid gas generating composition of claim 1, wherein the content ratio of component (b) is 2.0 mass % to 4.3 mass %.

6. The liquid gas generating composition of claim 1, wherein said component (b) consists of CMCNa alone.

7. The liquid gas generating composition of claim 2, wherein said component (b) comprises a combination of CMCNa and potassium alum in a weight ratio of 0.25 to 40.

8. The liquid gas generating composition of claim 2, wherein said component (b) comprises a combination of CMCNa and potassium alum in a weight ratio of 1 to 10.

9. The liquid gas generating composition of claim 2, wherein said component (b) comprises a combination of CMCNa and titanium lactate in a weight ratio of 0.25 to 40.

10. The liquid gas generating composition of claim 2, wherein said component (b) comprises a combination of CMCNa and titanium lactate in a weight ratio of 1 to 10.

11. The liquid gas generating composition of claim 2, wherein said component (b) comprises a combination of CMCNa and basic aluminum acetate in a weight ratio of 0.25 to 40.

12. The liquid gas generating composition of claim 2, wherein said component (b) comprises a combination of CMCNa and basic aluminum acetate in a weight ratio of 1 to 10.

13. The liquid gas generating composition of claim 2, wherein the content ratio of component (c) is 8.7 mass % to 12.7 mass %.

14. A liquid gas generating composition comprising the following (a) to (c) components:

(a) 80 mass % to 85 mass % hydroxyammonium nitrate;

(b) 0.5 mass % to 5.0 mass % a thickening stabilizer comprising carboxymethyl cellulose sodium salt (CMCNa); and (c) 8.7 mass % to 12.7 mass % water, wherein said component (b) consists of (i) CMCNa alone, (ii) a combination of CMCNa and potassium alum in a weight ratio of 1 to 10, (iii) a combination of CMCNa and titanium lactate in a weight ratio of 1 to 10, or (iv) a combination of CMCNa and basic aluminum acetate in a weight ratio of 1 to 10.

15. A gel gas generating composition comprising the following (a) to (c) components:

(a) 80 mass % to 85 mass % hydroxyammonium nitrate;

(b) 0.5 mass % to 5.0 mass % a thickening stabilizer comprising carboxymethyl cellulose sodium salt (CMCNa); and (c) 8.7 mass % to 12.7 mass % water, wherein said component (b) consists of (i) CMCNa alone, (ii) a combination of CMCNa and potassium alum in a weight ratio of 1 to 10, (iii) a combination of CMCNa and titanium lactate in a weight ratio of 1 to 10, or (iv) a combination of CMCNa and basic aluminum acetate in a weight ratio of 1 to 10, wherein the gel gas generating composition has a gel strength of 20 to 1000 kPa.

* * * * *